US009675861B2

(12) United States Patent
Barnes

(10) Patent No.: US 9,675,861 B2
(45) Date of Patent: Jun. 13, 2017

(54) HYDRO ELIMINATOR FULL BODY EXERCISE SWIM MACHINE

(71) Applicant: Paul Augustine Barnes, Greenbelt, MD (US)

(72) Inventor: Paul Augustine Barnes, Greenbelt, MD (US)

( * ) Notice: Subject to any disclaimer, the term of this patent is extended or adjusted under 35 U.S.C. 154(b) by 0 days.

(21) Appl. No.: 14/607,957

(22) Filed: Jan. 28, 2015

(65) Prior Publication Data

US 2015/0328520 A1 Nov. 19, 2015

Related U.S. Application Data

(60) Provisional application No. 61/941,003, filed on Feb. 18, 2014.

(51) Int. Cl.
*A63B 21/00* (2006.01)
*A63B 21/068* (2006.01)
(Continued)

(52) U.S. Cl.
CPC ..... *A63B 69/10* (2013.01); *A63B 21/00185* (2013.01); *A63B 21/068* (2013.01); *A63B 21/156* (2013.01); *A63B 21/4015* (2015.10); *A63B 21/4019* (2015.10); *A63B 21/4029* (2015.10); *A63B 21/4034* (2015.10); *A63B 21/4035* (2015.10); *A63B 22/16* (2013.01); *A63B 22/18* (2013.01); *A63B 23/03516* (2013.01); *A63B 23/03558* (2013.01);
(Continued)

(58) Field of Classification Search
CPC ..... A63B 69/10; A63B 21/151; A63B 21/154–21/156; A63B 21/4011–21/4015; A63B 21/4017–21/1021; A63B 21/4029–21/4031; A63B 22/16; A63B 22/203; A63B 2022/206; A63B 23/03575; A63B 23/03591
See application file for complete search history.

(56) References Cited

U.S. PATENT DOCUMENTS 5,354,251 A * 10/1994 Sleamaker ..... A63B 21/156 482/142
5,366,426 A * 11/1994 Glavin ..... A63B 23/03516 482/126
(Continued)

*Primary Examiner* — Loan H Thanh
*Assistant Examiner* — Jennifer M Deichl
(74) *Attorney, Agent, or Firm* — Johnson Legal PLLC

(57) ABSTRACT

Disclosed is a swim trainer using a laterally displaceable torso support pad and two cables interconnecting the swimmer's opposite hands and feet: right hand with left foot, left hand with right foot. It incorporates tension physics with applied tension force displacement wherein the torso is supported with two degrees of motion, i.e., hinged front-to-back tilt and left-to-right displacement of the torso. The user's opposite hands and feet are interconnected by cables passing through pulleys located below the torso. As the user performs a simulated swim stroke, force is asserted on the cable ends, moving the entire body to the right or left along a defined lateral displacement path. The user controls the swimming stroke speed, therefore controlling the amount of resistance applied between hands and feet based on the lateral motion torso speed against torso weight pressing down on the central support.

5 Claims, 12 Drawing Sheets

(51) Int. Cl.

| | |
|---|---|
| ***A63B 22/16*** | (2006.01) |
| ***A63B 22/18*** | (2006.01) |
| ***A63B 22/20*** | (2006.01) |
| ***A63B 23/035*** | (2006.01) |
| ***A63B 23/04*** | (2006.01) |
| ***A63B 23/12*** | (2006.01) |
| ***A63B 69/10*** | (2006.01) |

(52) U.S. Cl.
CPC ..... *A63B 23/03583* (2013.01); *A63B 23/04* (2013.01); *A63B 23/12* (2013.01); *A63B 2022/206* (2013.01); *A63B 2208/0261* (2013.01); *A63B 2210/50* (2013.01); *A63B 2225/09* (2013.01)

(56) References Cited

U.S. PATENT DOCUMENTS

| | | | | |
|---|---|---|---|---|
| 6,142,912 | A * | 11/2000 | Profaci | A63B 69/10 434/254 |
| 6,790,163 | B1 * | 9/2004 | Van De Laarschot | A63B 21/0056 434/254 |
| 2014/0005004 | A1 * | 1/2014 | Hall, Sr. | A63B 69/10 482/55 |
| 2014/0315171 | A1 * | 10/2014 | Tsai | A63B 69/10 434/254 |

* cited by examiner

HYDRO ELIMINATOR FULL BODY EXERCISE SWIM MACHINE

FIELD OF THE INVENTION

The invention relates to exercise machines for swimmers.

BACKGROUND OF THE INVENTION

People are becoming more responsible and aware of their health through maintaining a good exercise program. It is not always convenient for everybody to go for a run or do laps in the local pool at their leisure. People are turning to other efficient exercise programs like home gyms and full body exercise machines in their homes to achieve and maintain good health.

The focus of the present invention is on the type of machine that allows an individual to exercise the whole body using a swimming technique applied and executed through the operation of the machine. The general operational system of these machines uses a resistance mechanism with a support frame built around it. These machines will have a cable running through the resistance mechanism and attached to the hands in the front. It may have sliding resistance hand pads on a rail for catch and release simulating a swim motion. In some cases the cable will be attached to an intermittent pulley, a flywheel for the feet or an independent resistance mechanism for the feet. And attached to the top of frame is the resting pad for the upper torso. Examples of these machines are disclosed in Kennedy U.S. Pat. No. 4,830,363; Rodgers, Jr. U.S. Pat. No. 4,844,450; Robertson, Jr. U.S. Pat. No. 4,948,119; and Van De Laarschot et al. U.S. Pat. No. 6,790,163.

All of the previous inventions have been driven by one thing, the "resistance mechanism," and its delivery function of intensity to create the core of the work-out. This point is reiterated in, Van De Laarschot et al. U.S. Pat. No. 6,790,163 at paragraphs (3)(4)(5) and (6) which gives an excellent example and explanation of the type and scope of previous swim machines that have been patented. The core element of these swim machines have been intensity, amount of resistance, increased amount of time and continuous level of resistance in relation to the swim stroke. According to Van De Laarschot et al. U.S. Pat. No. 6,790,163, serious injury can occur from their use, but the disclosed machine also uses a resistance mechanism.

There is a need for a paradigm shift in the development of the modem day swim exercise machine.

SUMMARY OF THE INVENTION

I have thrown away the heavy resistance mechanism and replaced it with competition body strength resistance. In this model, the body works against itself to achieve the desired heart rate that is needed to develop stamina and endurance equal to actual swimming.

In my view, the swim exercise machine should not have any more resistance than what an individual would encounter in the water as a swimmer. Therefore, the need for a sophisticated resistance mechanism in combination with a swim machine is not used. In actual swimming, a swimmer's body is propelled through water with the combination of kicking the legs while pulling the body through the water with the hands and arms. Swimmers also press their upper torso against the water to cause the legs to rise up. The upper torso is then canted to the side thereby creating less drag during the swim stroke. It is this natural concept of rhythmic swimming that has been achieved with the swim exercise machine of the present invention.

The present invention is a swim trainer that replicates the action of actual swimming, wherein said trainer comprises: (a) a Y-shaped front base support with a pair of spring pulley assembly post attachments with a cable and wrist harness, (b) a middle support frame with adjustable double horizontal stem rods, and (c) a rear cross section support roller system with a T-bar and kicker system with foot harnesses. A single vertical column support is erected in the center of the Y intersection of the base with a central pulley system attachment. The column serves as the base for a hinge that is attached to a glide bar. The hinged glide bar serves as a base for the torso support which is padded to receive the exerciser's torso. The hinge itself enabled the torso support and glide bar to tilt forward and backward. This feature of the current invention can be achieved by disengaging the hinge pin located on the left side of the hinge. The spring pulley assembly uses cables that are attached to the wrist harnesses and are then threaded through a central pulley system and attached to the leg harnesses using commercial or residential foot harnesses.

With the present invention, the user's cable-connected hands and feet work with the glide bar torso support, central pulley system and hinge tilt to interact during a controlled swim stroke and rate to create, distribute and control a natural resistance.

The construction of the present invention provides a machine with folding parts that are readily folded for compact storage and parts of extendable and contractible lengths that allow for users of different lengths to adjust the machine for use and to aid the user when getting upon the machine.

BRIEF DESCRIPTION OF THE DRAWINGS

FIG. 2 is also absent the torso support belt, the hinge locking pin and the commercial foot harness.

DETAILED DESCRIPTION OF THE INVENTION

The torso and shoulders play major roles in a swimmer's ability to stay afloat. First, the swimmer has to control his legs to keep them high in the water. A swimmer presses his upper body against the water to make the legs rise up in the water to eliminate drag and give the swimmer greater propulsion in the water. Second, the swimmer turns the torso from one side to the other during sequential strokes to minimize the contact surface area of the torso in the water during the swim stroke to achieve the maximum speed. When executed properly, the swimmer glides through water and stays afloat. The current invention replicates this action to help the swimmer train.

According to the invention, the natural motion of the swimmer and his or her weight is used in a trainer that does not require external weights or resistance. Such a swim trainer device includes:

(a) a forward assembly configured to support a swimmer's torso on a laterally displaceable support pad that is elevated above a base by its connection to a vertically extended support column that is sufficiently high to allow each hand of said swimmer to move in directions that reflect swimming motions;

(b) a rear assembly that receives left and right feet of said swimmer and allows each foot to move in up and down directions that simulate swim kicking;

(c) axially extended supports connecting said forward assembly and said rear assembly;

(d) a first cable connecting a right hand harness with a left foot harness through a first pulley mounted on a right side of said support column;

(e) a second cable connecting a left hand harness with a right foot harness through a second pulley mounted on a left side of said support column;

(f) a transverse glide bar mounted on top of said support column under said displaceable pad whereby coordinated leg kicking motions and arm swimming motions cause the torso of said swimmer to move said displaceable support along said transverse glide bar.

Preferably, the forward assembly further includes: (a) a right lateral support leg and a left lateral support leg, each support leg extending generally outwardly from said base; (b) a spring-biased, third pulley that is mounted on said right lateral support leg and which guides said first cable to said right hand harness; and (c) a spring-biased, fourth pulley that is mounted on said right lateral support leg and which guides said second cable to said left hand harness.

Figure 1:
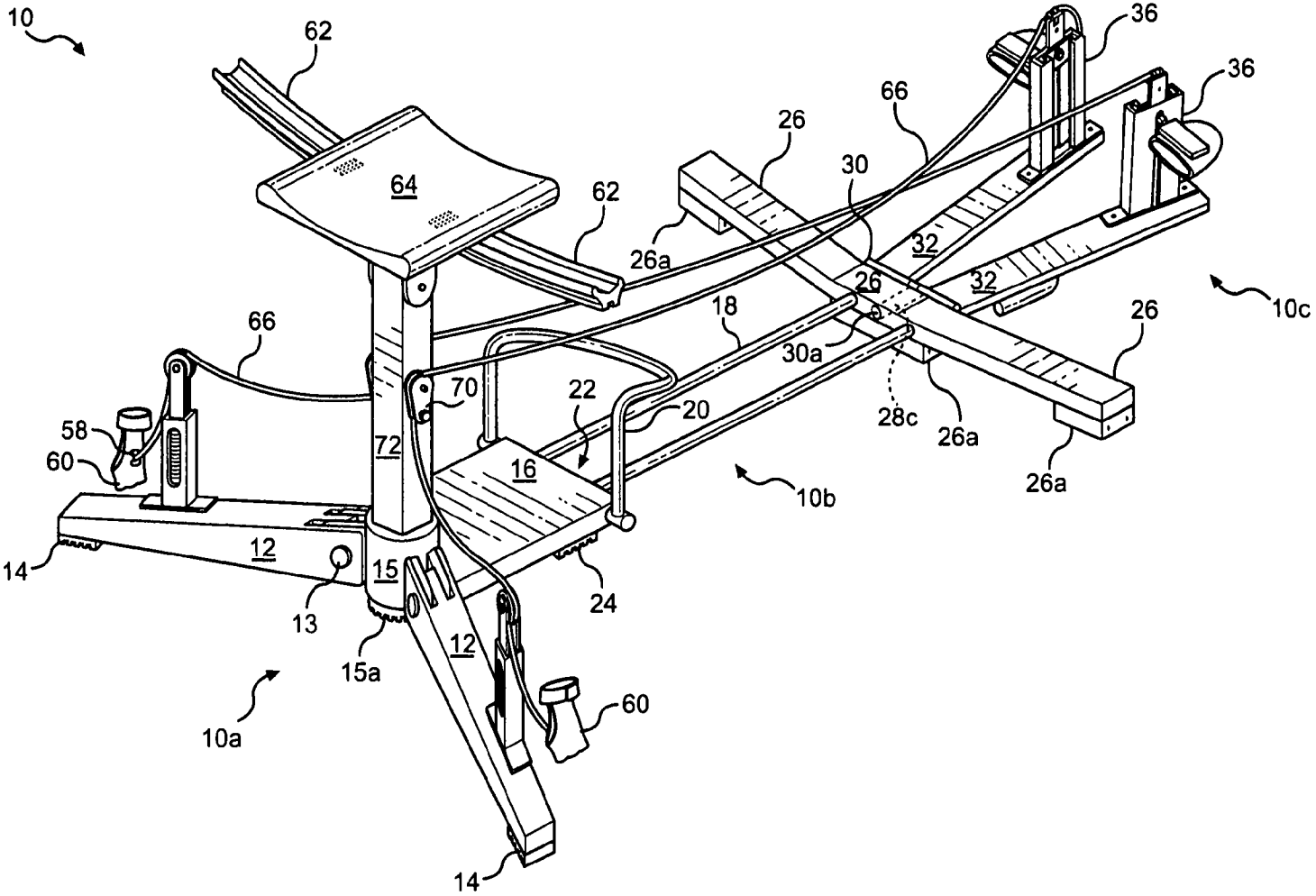
FIG. 1 shows an overall view of the invention absent the torso support belt, the hinge locking pin and the commercial foot harness.

Referring to FIG. 1 of the drawings, the base 10 and has three sections front base support 10*a*, middle base support 10*b*, and a rear base support 10*c*. The front base support 10*a* can be made of a hard plastic or alloy steel and includes the pectoral fin arms 12 with steel locking pins 13 and rubber shoes 14, the support column base 15 and rubber shoe 15*a*.

The Middle base 10*b* can be made of a hard plastic or alloy steel includes middle support frame 16, double horizontal stem rods 18 (made of steel only), locking stem rod device handle 20 which can be made of alloy steel, and the stem rod locking device 22 made of alloy steel (not illustrated) and rubber support shoe 24.

Figure 2:
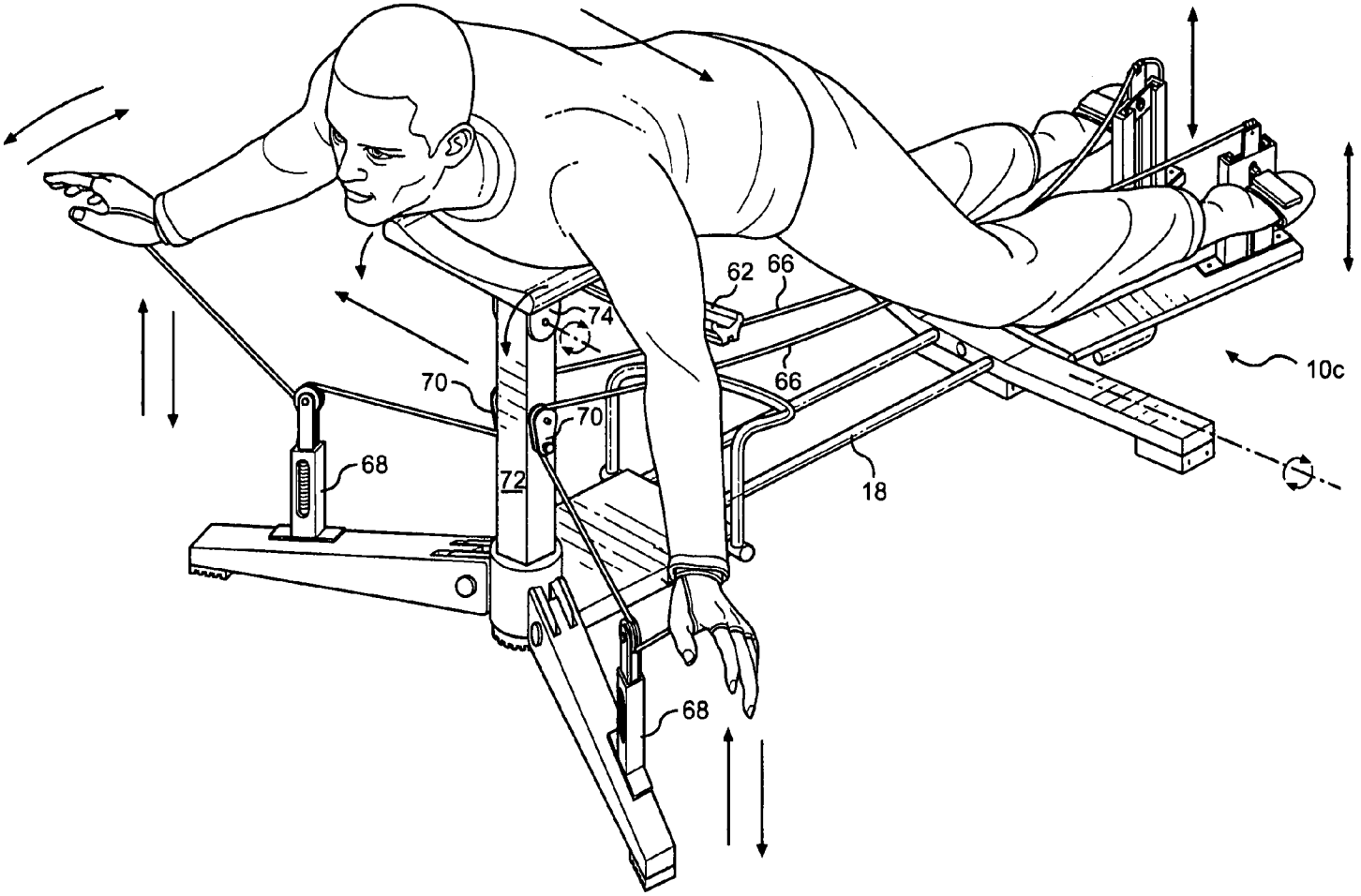
FIG. 2 shows a general illustration of embodiment of the invention with arrows showing general directions of the hands and feet as they are attached to one another, the motion of the seat tilt absent the side-to-side motion of the seat during the glide bar function.
Figure 7:
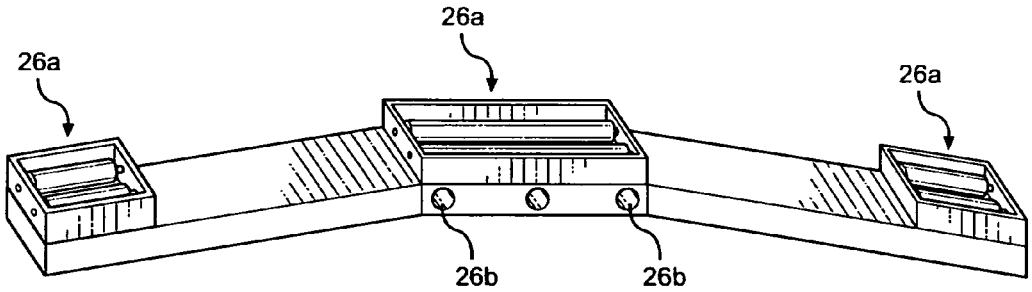
FIG. 7 shows the under view of the pelvic cross section rear support rollers.
Figure 8:
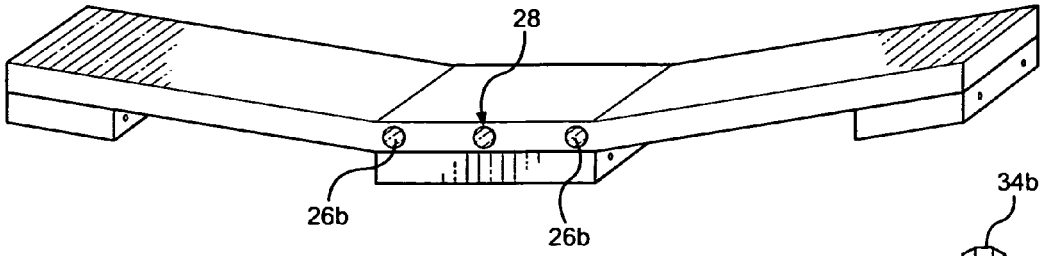
FIG. 8 shows the top side of the pelvic cross section rear support rollers
Figure 9:
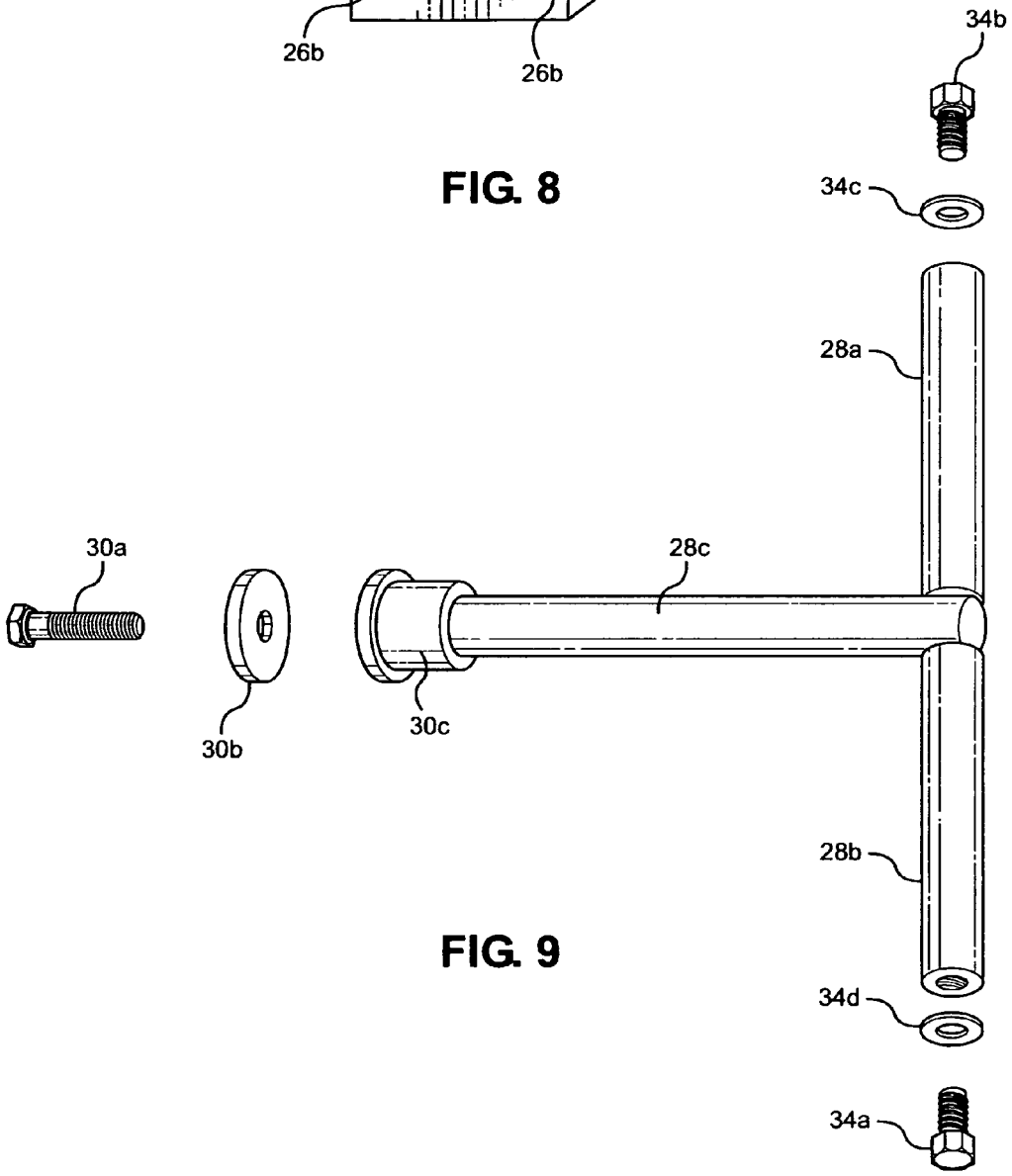
FIG. 9 shows the T-bar, plastic bushing, washer and attachment bolt.

The rear base 10*c* shows the pelvic fin cross section roller system 26. This section can be made of a hard plastic or alloy steel, using rubber for the roller surface. FIG. 7 shows the underside of the rear base pelvic fin cross section roller system 26, the roller housing 26*a*, and roller placement in housing 26*a*. FIG. 8 shows the upright side of rear base pelvic fin cross section roller system 26 with T-bar hole 28 shown. FIG. 1 and FIG. 2 shows the inserted T-bar portion 28*c* into the T-bar hole 28 secured with bolt 30*a*. In FIG. 9 the first and second T-bar portions 28*a* and 28*b* are wielded to the stem portion 28*c* and all three are made of alloy steel.

FIG. 2 shows the user in the horizontal position with torso pressed against the torso support pad 64. The arrows in FIG. 2 show the motions involved with the training process. Torso support pad 64 rotates about a transverse axis during the simulated swim stroke. In FIG. 2 the torso arrows also shows the invention's ability to cause the users' torso to slightly turn on its side during the simulated swim stroke, thus simulating minimizing the contact surface area in the water.

Inspection of the figures will allow those in this art a better understanding of the mechanics of the invention. For example, the long indicator arrows above and below the users' torso in FIG. 2 shows the displacement motion of the swimmer's hands and feet as the swimmer trains with a simulated swimming stroke. The displacement force on the device that is asserted on the body of the swimmer causes the movement and the resulting exercise effects. The hand harness 60 and the cable 66 pass through the tension string pulley of the outer spring pulley assembly 68, and then pass through the tandem pulley of the central pulley system 70 before connecting to the inline cable adjustor 48 of the opposite foot. (These connections will be talked about more in detail below). The swimmer's torso moves laterally along the glide bar 62 in the direction of the tension. Because the glide bar 62 is slightly curbed, the body becomes tilted to the side in the movement. This affect causes a pendulum motion of the torso that the user will have to control with the muscle groups used in swimming thus causing the user to assert energy and develop those muscle groups.

Figure 3:
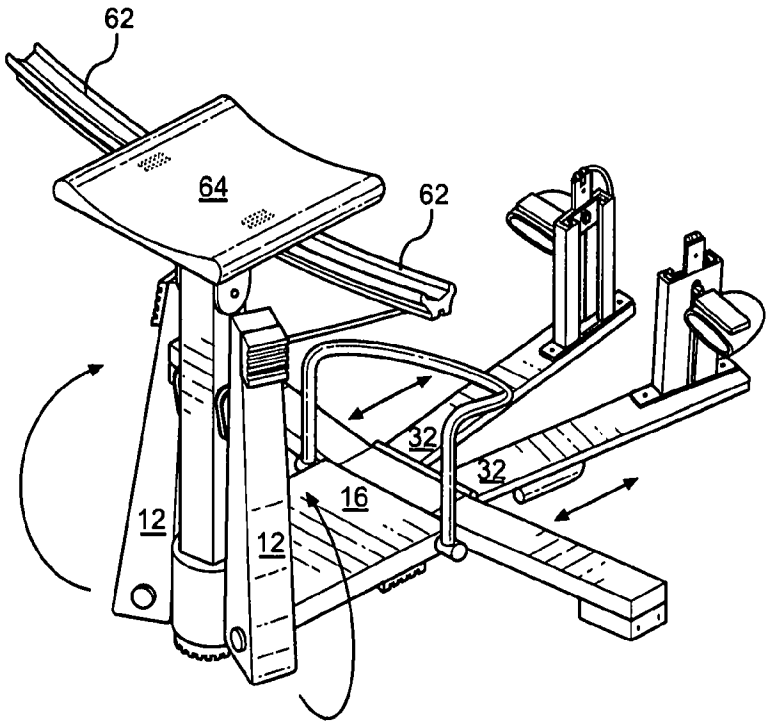
FIG. 3 shows the invention in its collapsed and retracted position for storage.
Figure 10:
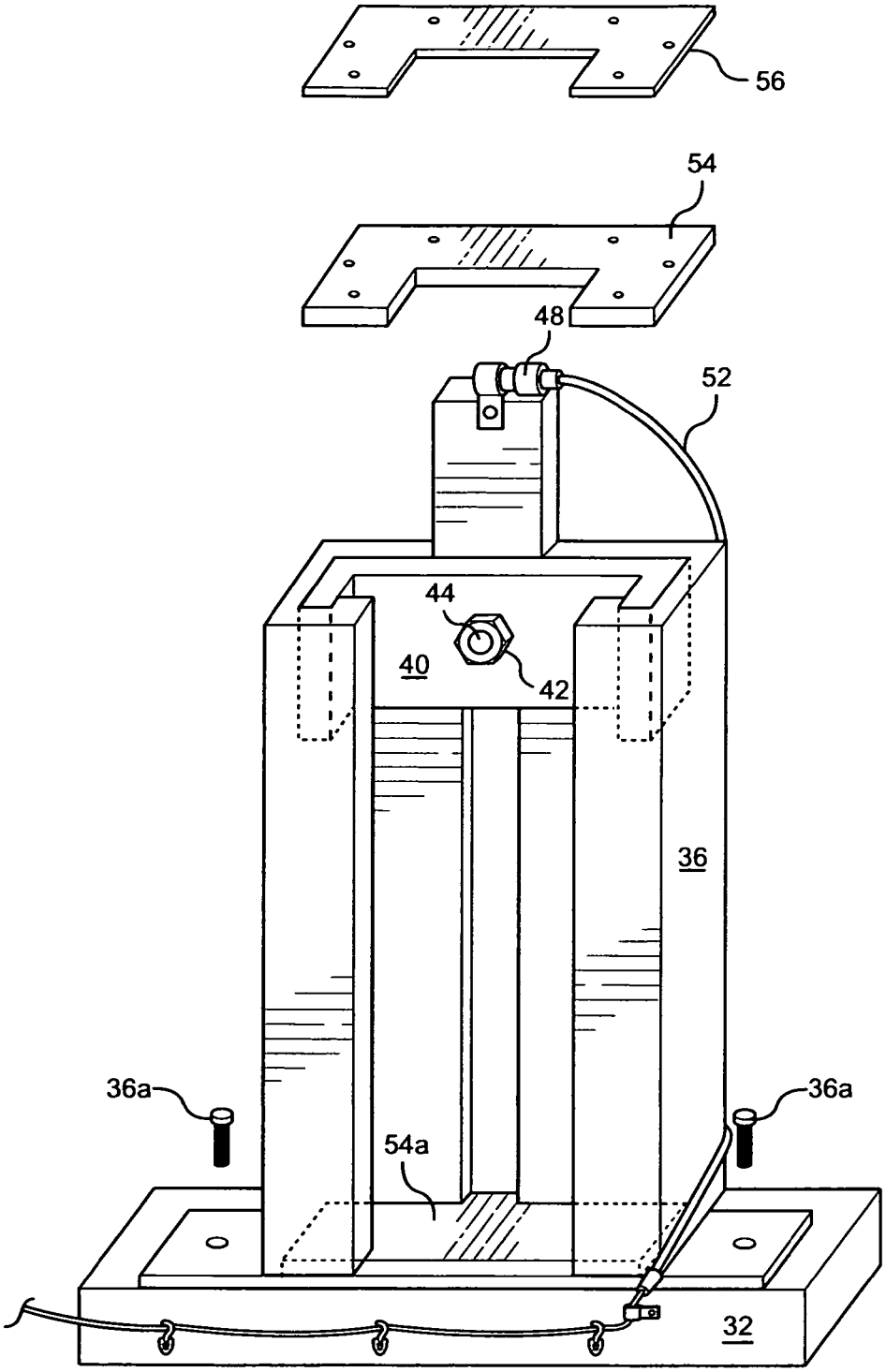
FIG. 10 shows the caudal kicker system components and excess cable storage.
Figure 11:
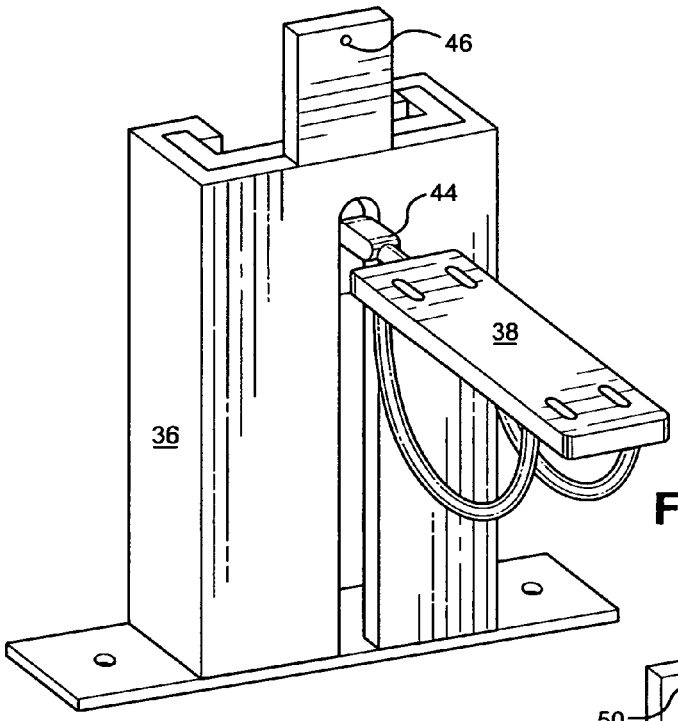
FIG. 11 shows the caudal kicker system with the commercial foot harness to be used with shoes.

FIGS. 1, 2 and 3 further show the rear base 10*c* with the caudal kicker system fins 32 attached to the T-bar 30 and secured with bolts 34*a* and 34*b*. (See also FIG. 9.) FIG. 1 further shows the caudal kicker mechanism 36 attached to the kicker fins with bolts 36*a* also shown in FIG. 10 and FIG. 12. The caudal kicker mechanism 36 can be made of hard plastic for light-weight and reduced noise during the kicking motion of training. FIG. 11 shows the commercial foot harness 38 attached to caudal kicker mechanism 36. FIG. 10 shows the inside view of the caudal kicker mechanism 36 exposing the free siding block 40 illustrated using slotted lines. FIG. 10 further exposes the securing nut 42 for the foot harness attachment arm 44 which is also shown in FIG. 11.

Figure 4:
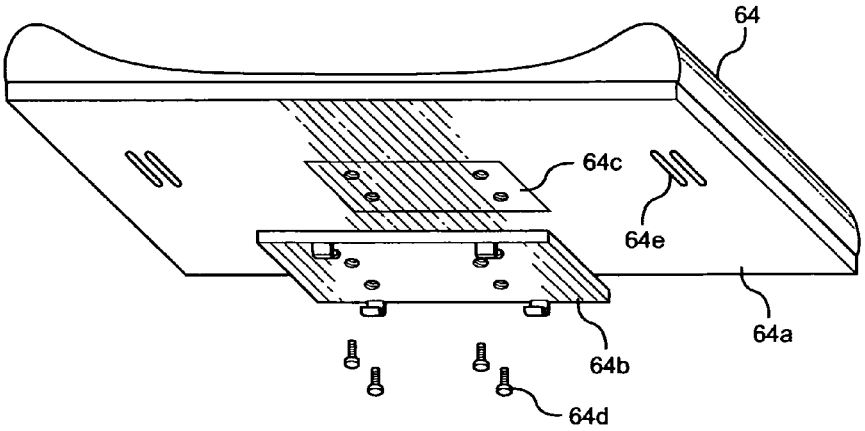
FIG. 4 shows the seat padding, padding support plate with bracketing area, seat belt slots and seat-to-glide bar attachment bracket with four mounting screws.
Figure 5:
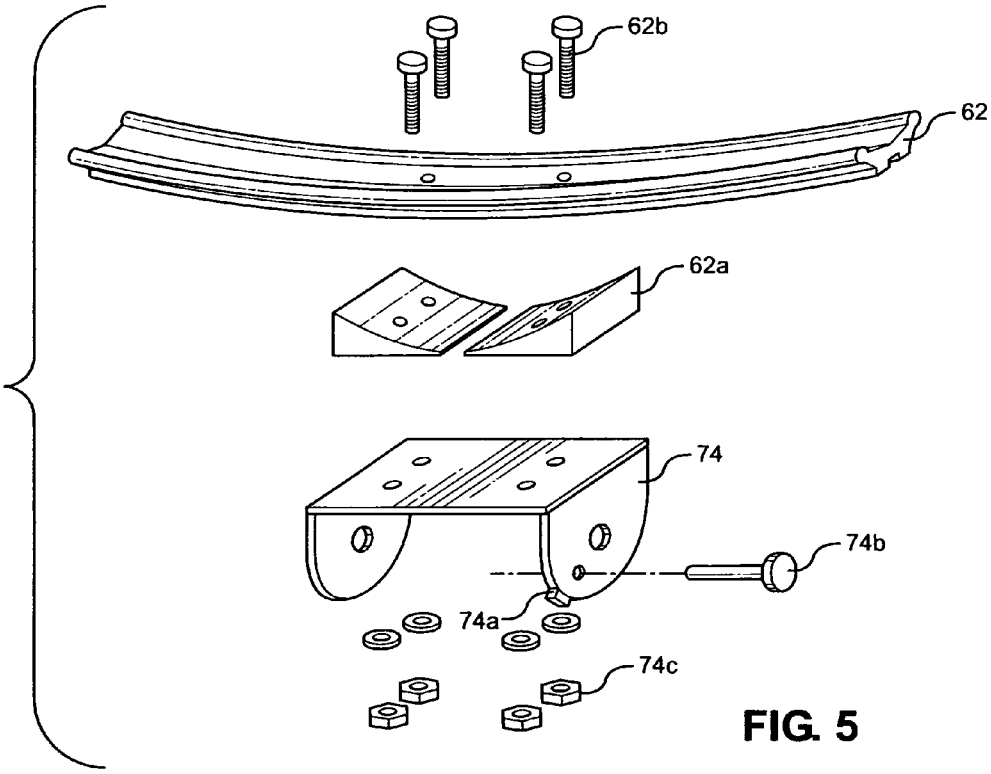
FIG. 5 shows the glide bar and hinge assembly with the hinge pin present and the stop tilt nipple adjacent the hinge pin hole on left.

FIGS. 4 and 5 show details associated with the hinged, laterally displaceable support system for torso support pad 64. In FIG. 4, torso support pad 64 is connected to support plate 64*a*; the torso pad-to-glide bar mounting bracket 64*b*, bracket anchoring area 64*c*, screws 64*d*, and safety belt slots 64*e*. Support plate 64*a* exhibits two pair of L-shaped fins that are configured to engage front and back supporting projections of curved glide bar 62 without interfering with the ability of mounting bracket 64*b* to move along glide bar 62 when the L-shaped fins are engaged with the supporting projections of glide bar 62.

FIG. 5 shows hinge 74 and its associated assembly with the stop tilt nipple 74*a* on left side with hinge release pin 74*b*, anchor nuts, and washers 74*c*. FIG. 5 further shows the glide bar 62 and associated assembly with bar-to-hinge spacers 62*a* that convert the curvature of glide bar 62 to flat surfaces that are secured to the flat upper surface of hinge 74, anchoring bolts 62*b*, nuts, and washers 74*c*.

Figure 6:
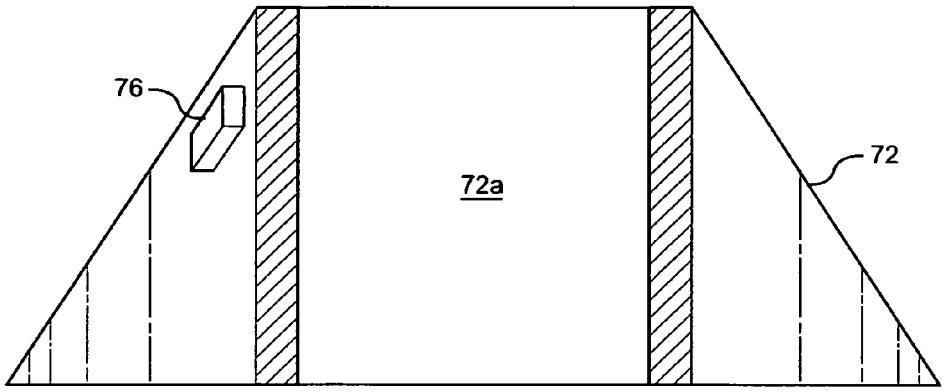
FIG. 6 shows the top of the support column with the platform stopping mechanism positioned on the left, with the slotted area illustrating the hinge position.

FIG. 6 shows the stop tilt mechanism 76 mounted on support column 72.

Figure 12:
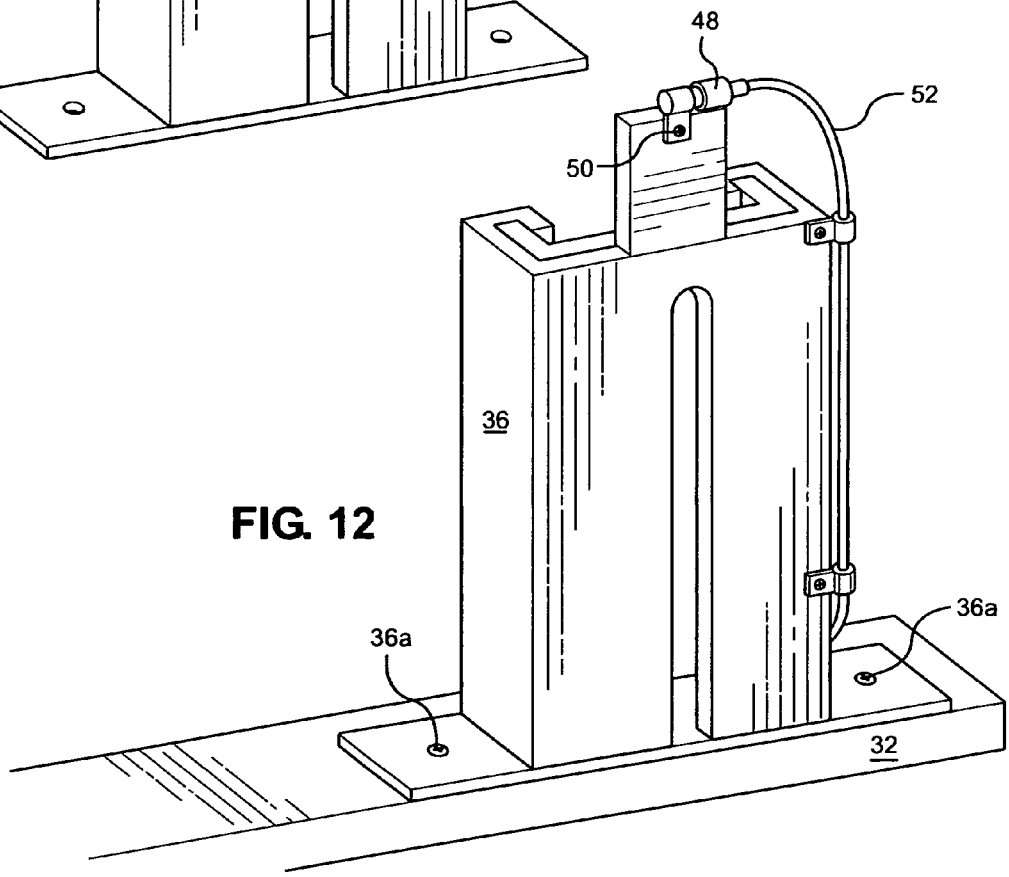
FIG. 12 shows the route of the cable at the kicker system and method of attachment.
Figure 13:
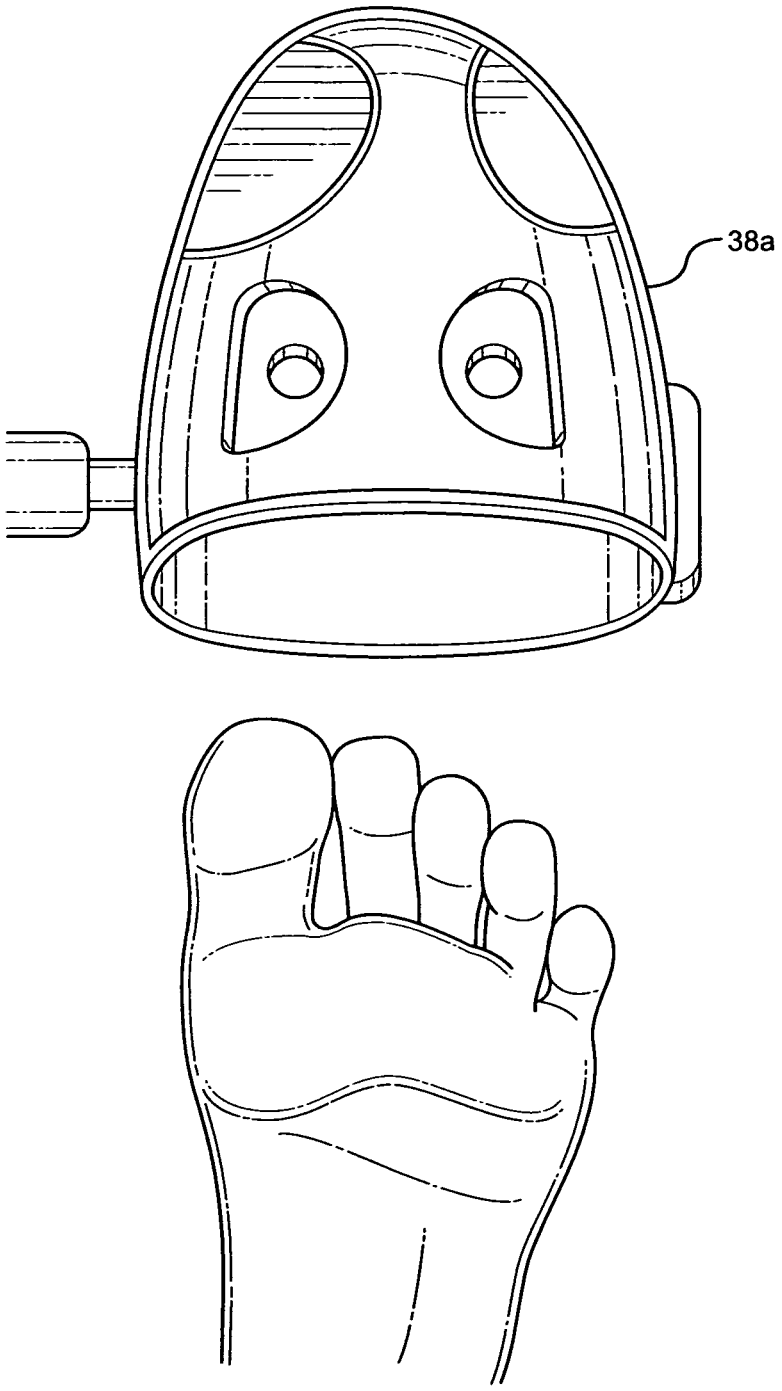
FIG. 13 shows the residential foot harness to be used without shoes.
Figure 14:
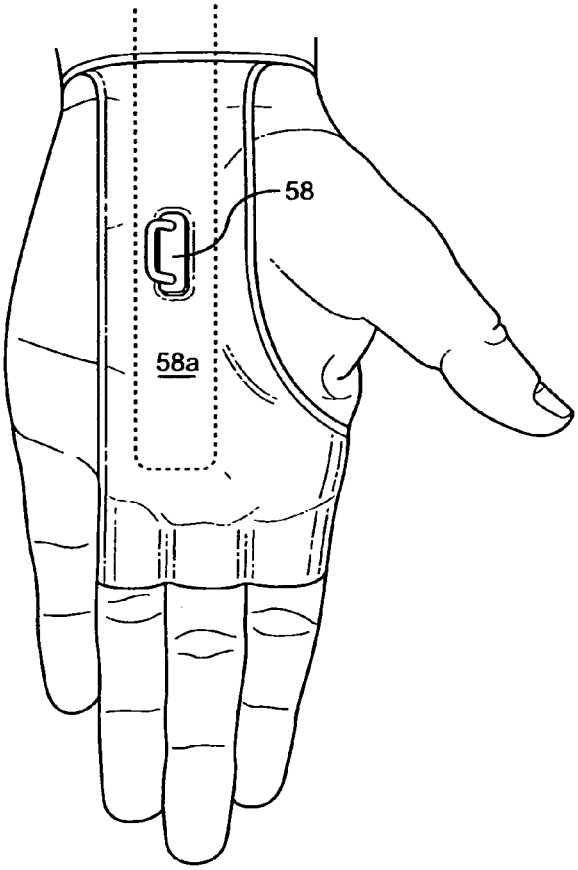
FIG. 14 shows the palm side of the hand harness with D-shaped hook attached to a metal plate inside the harness material illustrated by slotted lines.
Figure 15:
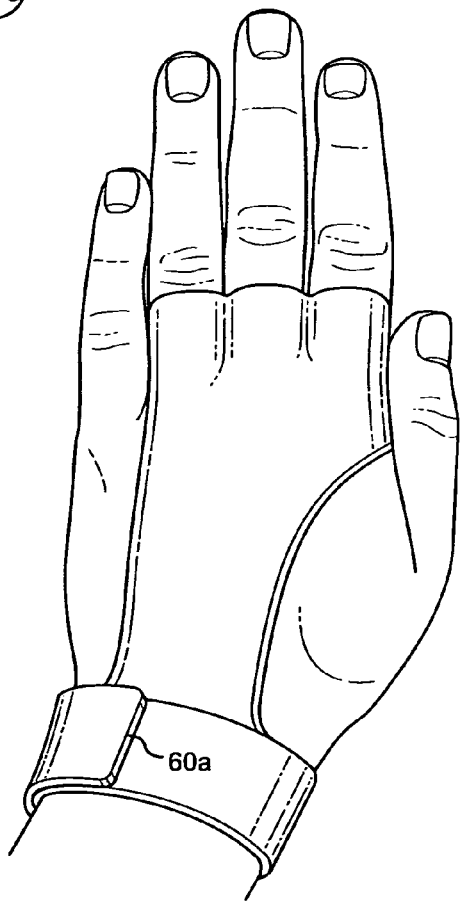
FIG. 15 shows the back side of the hand harness.

FIG. 11 further shows the inline cable adjustor hook port 46. FIG. 12 shows the inline cable adjustor 48 connected to the inline cable adjustor hook port 46 with bolt 50. FIG. 10 and FIG. 11 further shows the routing of the excess cable 52. FIG. 10 further shows the rubber cushion 54 and 54*a* which is placed on top and at the bottom of the caudal kicker mechanism 36 as a cover and noise reducer for the free siding block 40. FIG. 10 is completed with cover plate 56 which secures cushion 54 in place with screws (not illustrated). FIG. 13 shows the residential foot harness 38*a* which can be made of soft rubber, soft plastic or leather. FIG. 14 shows the hand harness 60 with the steel pulley D-ring hook 58 attached to the inserted alloy steel anchor plate 58*a*, illustrated by slotted lines; of the palm side of the hand harness 60. FIG. 15 shows the back side of the hand harness 60, with hook-and-loop fastener wrist band 10*a*. The hand harness 60 can be made of leather or nylon.

Support column 72 is inserted into column base 15 and secured with fasteners around its circumference (not illustrated). As shown in FIG. 2, support column 72 should be sufficiently high to allow each hand of a swimmer on the torso support pad 64 to move in directions that reflect swimming motions. Torso support pad hinge 74 is attached to the top of column support 72. The rotational arrows shown in this figure show that pad hinge 74 is attached to provide rotation about an axis that is transverse to the central axis of the device.

FIG. 3 shows the invention in its collapsed position, with the double horizontal stem rods 18 inserted into the middle base support 10*b*, the pectoral fin arms 12 folded in the upright position. Although it is not illustrated, caudal kicker fins 32 can be folded up towards the glide bar 62. These three folding features make the invention considerably smaller and therefore ready for storage in many homes.

Figure 16:
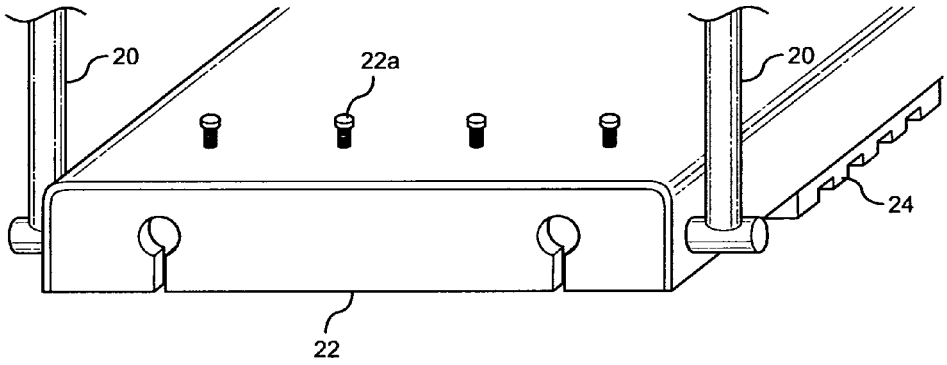
FIG. 16 shows the middle base support frame with the double horizontal stem rod locking device.

FIG. 3 shows the preferred starting position for the trainer of the invention to be in when the user begins to adjust the trainer for use. The user will disengage horizontal stem rod locking device 22 (shown in detail in FIG. 16) by rotating locking handle 20 out of frictional engagement with stem rods 18, bringing rear base support 10*c* forward, and locking it in the forward position using the locking handle 20. The user will then place his/her torso on the torso support pad 64 and secure the safety belt (not illustrated). The user will then insert his/her feet into the caudal kicker mechanism 36 commercial foot harness 38 or residential foot harness 38*a*, disengage the locking handle 20, and then push rear base support 10*c* to the desired length and lock it in place with locking handle 20.

Figures 17, 18:
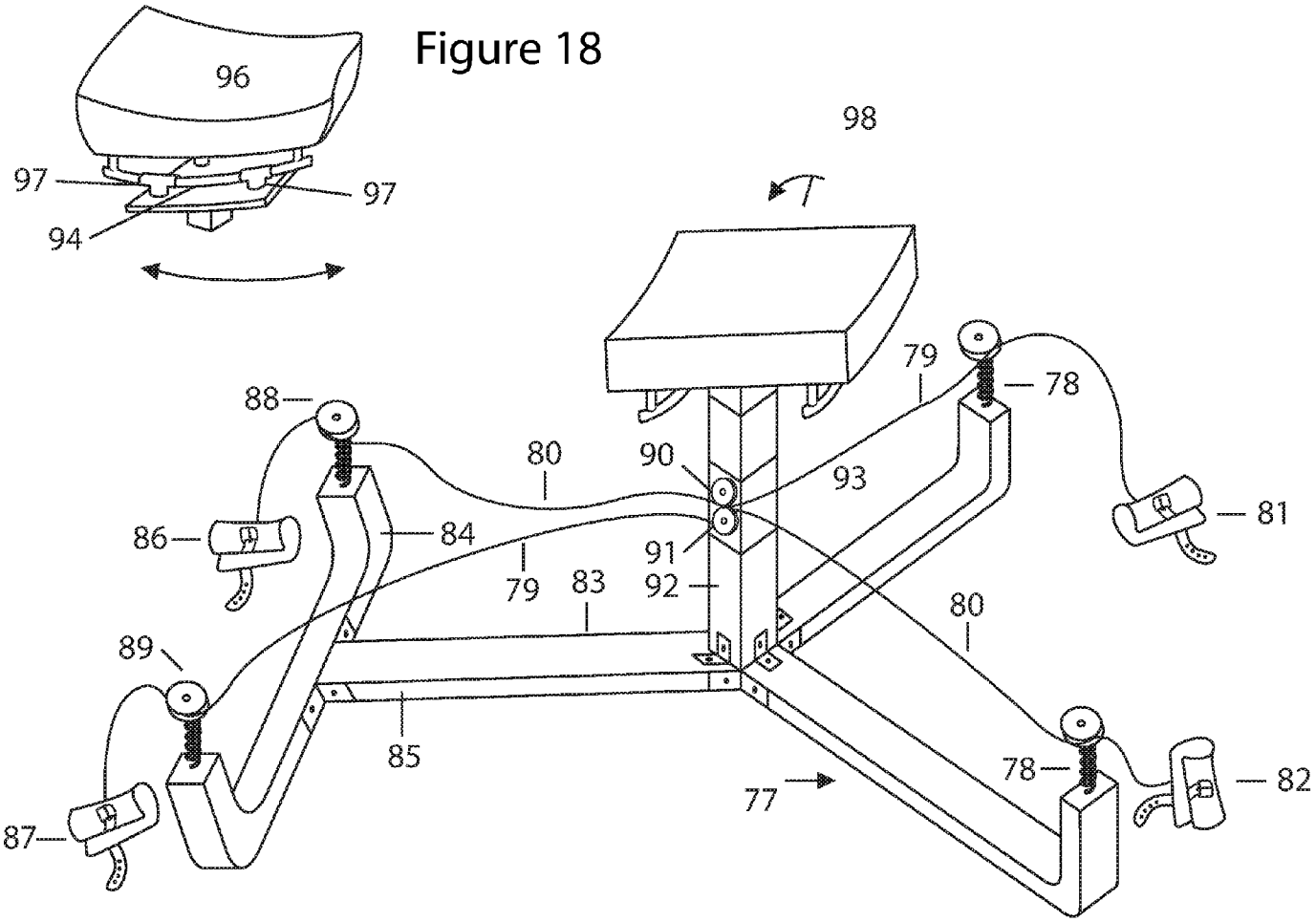
FIG. 17 depicts an alternate embodiment of a fixed length.
FIG. 18 shows another view of the torso support from FIG. 17.

FIGS. 17 and 18 show an alternate embodiment having a fixed length system. As shown, the swim trainer comprises: (a) a Y-shaped front base support 77 with a pair of spring-biased pulleys 78 guiding first and second hand cables 79, 80 and left and right wrist harnesses 81, 82, (b) a middle support frame 83, and (c) a rear cross section support 84 roller system with a T-bar 85 and kicker system with left and right foot harnesses 86, 87 and left or right rear spring-biased pulleys 88, 89. Left wrist harness 81 is connected to right foot harness 87 with cable 79 through first central pulley 90. Right wrist harness 82 is connected to left foot harness 88 with second cable 80 through second central pulley 91. The leg harnesses 86, 87 using commercial or residential foot harnesses.

A single vertical column support 92 is erected at connection of Y-shaped front base support 77 with middle support frame 83. First and second central pulleys 90, 91 are mounted on vertical column support 92 to guide cables 79, 80. Column support 92 serves as the base for a transverse hinge 93 that is attached to glide bar 94 with guide bracket 97. The detailed construction of the hinged torso support system may also be the same as the embodiment shown in FIGS. 4 and 5.

The hinged glide bar 94 serves as a base for the torso support 96 which is padded to receive the exerciser's torso and move laterally along glide bars 94. Hinge 93 enables the torso support 96 and glide bar 94 to tilt forward and backward about hinge axis 98.

Hinge 93 can be locked in position and against rotation by a hinge pin (not shown). Disengaging the hinge pin allows the hinge to rotate.

What I claim my invention to be:

1. A personal swim trainer that comprises:

a. a forward assembly configured to support a swimmer's torso on a laterally displaceable support pad that is elevated above a base by its connection to a vertically extended support column that is sufficiently high to allow each hand of said swimmer to move in directions that reflect swimming motions;

b. a rear assembly that receives left and right feet of said swimmer and allows each foot to move in up and down directions that simulate swim kicking;

c. axially extended supports connecting said forward assembly and said rear assembly;

d. a first cable connecting a right hand harness with a left foot harness through a first pulley mounted on a right side of said support column;

e. a second cable connecting a left hand harness with a right foot harness through a second pulley mounted on a left side of said support column;

f. a transverse glide bar mounted on top of said support column under said displaceable pad whereby coordinated leg kicking motions and opposite arm swimming motions cause the torso of said swimmer to move said displaceable support along said transverse glide bar.

2. A swim trainer according to claim 1 wherein said forward assembly further comprises:

g. a right lateral support leg and a left lateral support leg, each support leg extending generally outwardly from said base, h. a spring-biased, third pulley that is mounted on said right lateral support leg and which guides said first cable to said right hand harness; and i. a spring-biased, fourth pulley that is mounted on said right lateral support leg and which guides said second cable to said left hand harness.

3. A swim trainer according to claim 1 wherein the connection between said vertically extended support column and said laterally displaceable support pad comprises a hinge that allows the support pad to tilt front-to-back around a transverse tilt axis.

4. A swim trainer according to claim 1 further comprising a pair of horizontal rods connecting the forward assembly with the rear assembly and passing through a rod locking device that is frictionally engageable with said rods.

5. A swim trainer according to claim 1 wherein said glide bar is arcuately curved.

* * * * *